US007849906B2

(12) United States Patent
Kraeutler

(10) Patent No.: US 7,849,906 B2
(45) Date of Patent: Dec. 14, 2010

(54) FAST DOOR WITH SECURE OPERATION

(75) Inventor: Bernard Kraeutler, Dunieres (FR)

(73) Assignee: Nergeco (FR)

( * ) Notice: Subject to any disclaimer, the term of this patent is extended or adjusted under 35 U.S.C. 154(b) by 106 days.

(21) Appl. No.: 11/630,746

(22) PCT Filed: Jun. 22, 2005

(86) PCT No.: PCT/IB2005/001761

§ 371 (c)(1),
(2), (4) Date: Sep. 4, 2007

(87) PCT Pub. No.: WO2006/000882

PCT Pub. Date: Jan. 5, 2006

(65) Prior Publication Data

US 2008/0060772 A1 Mar. 13, 2008

(30) Foreign Application Priority Data

Jun. 22, 2004 (FR) ..... 04 06781

(51) Int. Cl.
*A47H 5/02* (2006.01)

(52) U.S. Cl. ..... 160/84.02; 160/10

(58) Field of Classification Search ..... 160/84.01, 160/84.02, 84.04, 84.06, 10; 49/31, 322
See application file for complete search history.

(56) References Cited

U.S. PATENT DOCUMENTS 4,718,471 A * 1/1988 Kraeutler ..... 160/84.02
4,727,919 A * 3/1988 Kraeutler ..... 160/84.02
4,828,003 A * 5/1989 Kraeutler ..... 160/84.02
5,072,767 A * 12/1991 Kraeutler ..... 160/84.01
6,116,319 A * 9/2000 Simon ..... 160/84.01
6,145,572 A * 11/2000 Kraeutler ..... 160/310
2006/0144526 A1 * 7/2006 McGinley ..... 160/84.01

FOREIGN PATENT DOCUMENTS

DE 27 25 939 12/1978
EP 0 819 204 1/1998

OTHER PUBLICATIONS

International Search Report; PCT/IB2005/001761; Aug. 30, 2005.

* cited by examiner

*Primary Examiner*—David Purol
(74) *Attorney, Agent, or Firm*—Cantor Colburn LLP

(57) ABSTRACT

The invention concerns a fast door, closing an opening provided in a partition, comprising a soft screen (21), means for lifting the screen including, among others, a winding shaft (2) fixed at the door lintel, and a strap (7) whereof one end is fixed to the winding shaft (2) and the other end is fixed to the screen lower edge (8). The invention is characterized in that the strap (7) passes through a tension sensor (6) comprising a mobile element having an opening wherein the strap (7) is engaged, the mobile element being maintained in a first so-called normal operating position by the strap (7), the latter being subjected to a normal operating tension, the mobile element tilting into a so-called abnormal operating position, when the strap (7) shows a tension lower than a predetermined threshold corresponding to an abnormal operation of the door.

8 Claims, 3 Drawing Sheets

FAST DOOR WITH SECURE OPERATION

TECHNICIAL FIELD OF THE INVENTION

The present invention relates to a fast door, the operation of which is secure.

DESCRIPTION OF THE RELATED ART

In the technical field of fast doors, that is to say doors comprising a flexible screen which can pass rapidly from a closing position to an opening position, a constant preoccupation is the securitization of the operation of these doors. These doors can be made to carry out a large number of open/close cycles and failures may regretfully occur which are liable to result in a rapid descent of the screen. The screen may thus fall on a person, with consequent risk of injury.

In the case of a roll-up door, that is to say a door whose raising is realized by the rotation of a shaft on which the screen is wound, it is known through document EP-A-819 204 to provide an indicator strap, whereof one end is fixed on the winding shaft, while the other end is fixed to the base of the screen. This indicator strap is inactive in the raising of the screen. However, it proves extremely useful in case of malfunction of the door. In fact, this strap is coupled to a moving member which assumes a warning position when the tension of the strap is less than a predetermined tension.

BRIEF SUMMARY OF THE INVENTION

In the case of a folding door, that is to say a door whose raising is realized by traction straps connected, to the winding shaft and to the lower edge of the screen, one or all of these straps can be coupled to the moving member known through document EP-A-819 204. Said moving member assumes a warning position when the tension of one of the straps is less than a predetermined tension.

The lowering of the tension in the indicator strap or in one of the tension straps can be due to a number of causes. These can include:

- an obstacle in the passage of the door. The screen then lowers onto this obstacle. The shaft then continues its rotation without the screen reaching the ground. The strap connected to the base of the screen is no longer subjected to its normal tension given by the weight of the screen, which then triggers an alarm,
- an intrusion attempt through raising of the lower edge of the door. The raising of the door produces a lowering of tension of the strap, which then triggers a warning,
- a breakage of the traction strap.

The moving member, such as described in document EP-A-819-204, is generally satisfactory, insofar as it allows an alarm to be triggered in case of an obstacle placed in the trajectory of descent of the screen or in case of intrusion.

Nevertheless, the reliability of this member is open to improvement.

The invention generally provides a fast door having a security device which works by monitoring the tension of a strap and is extremely reliable.

The invention further generally proposes a security device which can be easily adapted to existing fast doors.

To this end, the subject of the invention is essentially a fast door closing an aperture made in a partition and comprising

- a flexible screen
- screen-raising means, comprising, inter alia, a winding shaft fixed level with a lintel of the door, and

- a strap, whereof one end is fixed on the winding shaft and the other end is fixed to the base of the screen,
- characterized in that the strap passes through a tension detector comprising a moving element having an opening in which the strap is engaged, the moving element being held in a first, so-called "normal working" position by the strap, the latter being subjected to a normal operating tension, the moving element tilting into a so-called "abnormal working" position whenever the strap has a tension less than a predetermined threshold corresponding to an abnormal working of the door.

Thus, the idea behind the invention is to engage a strap in a tension detector which tilts when the tension of the strap is not equal to the normal tension. The tension detector does not interfere with the operation of the door when this is working normally. However, when the screen meets an obstacle in the course of its descent, the shaft continues its rotation and the strap passing through the tension detector slackens, inevitably producing a tilting of the latter.

The tension detector also tilts toward its abnormal working position in the case of an intrusion attempt via the lower edge of the screen. A raising of the lower edge of the screen likewise produces a lowering of tension in the strap passing through the tension detector.

The high reliability of the door tension detector according to the invention is due to the fact that the strap passes directly into a moving element, the tilting of which allows an abnormal working of the door to be signaled.

According to one advantageous embodiment, the moving element of the tension detector is pulled toward the second, so-called abnormal working position by a return spring.

Preferably, the displacement of the moving element from its normal working position to its abnormal working position triggers a warning.

In one embodiment, the tension detector comprises a cylinder which is rotatable about its axis and in which a slit is made which passes through its axis and in which the strap is engaged.

This embodiment proves extremely advantageous in terms of operating reliability and compactness, which allows existing doors to be equipped with a tension detector according to the invention.

In addition, it will be noted that the moving cylinder is supported by two end plates.

One advantageous characteristic of the invention provides that the cylinder is provided with a pin traversing a circular-arc-shaped groove made in one of the end plates, this pin making contact with a finger connected to warning means when the cylinder is in the abnormal working position.

By adjusting the position of the finger, it is thus possible to adjust the sensitivity of the device. According to the adjustments, a slight angular course of the pin (and hence of the cylinder) or a marked angular course of the pin can, at the discretion of a user, trigger a warning.

It will be noted that the detector has at least one cylindrical roller, by which the strap can be guided toward the moving cylinder. As a result of this characteristic, it will further be seen that the detector is an autonomous element which can be very easily installed on an existing door.

According to two possible embodiments:

- the door is a folding door, the strap serving as traction means for the screen,
- the door is a roll-up door, the strap serving an indicator strap signaling the proper tension of the screen.

In this latter scenario, the strap could pose a safety problem, especially if a person were to pass an arm into said strap. To avoid this type of drawback, the strap can conceivably be fixed to the lower edge of the screen by connecting means capable of rupturing under a predetermined force.

According to a number of options:

- the connecting means are constituted by two elements of self-adhesive material, of the hook and eye type, placed respectively at the end of the strap and on the screen,
- the connecting means are constituted by two magnetic elements of different polarity, placed respectively at the end of the strap and on the screen,
- the connecting means are constituted by a breakable zone provided in the strap.

Thus, the safety problem is resolved and, in the event of a breakage of the connection between the strap and the screen, the strap no longer has any tension; the tension detector device then assumes its abnormal working configuration.

BRIEF DESCRIPTION OF THE DRAWINGS

For a clear understanding thereof, the invention is described with reference to the appended drawing representing, by way of non-limiting example, several embodiments of doors according to the invention.

DETAILED DESCRIPTION OF THE INVENTION

Figure 1:
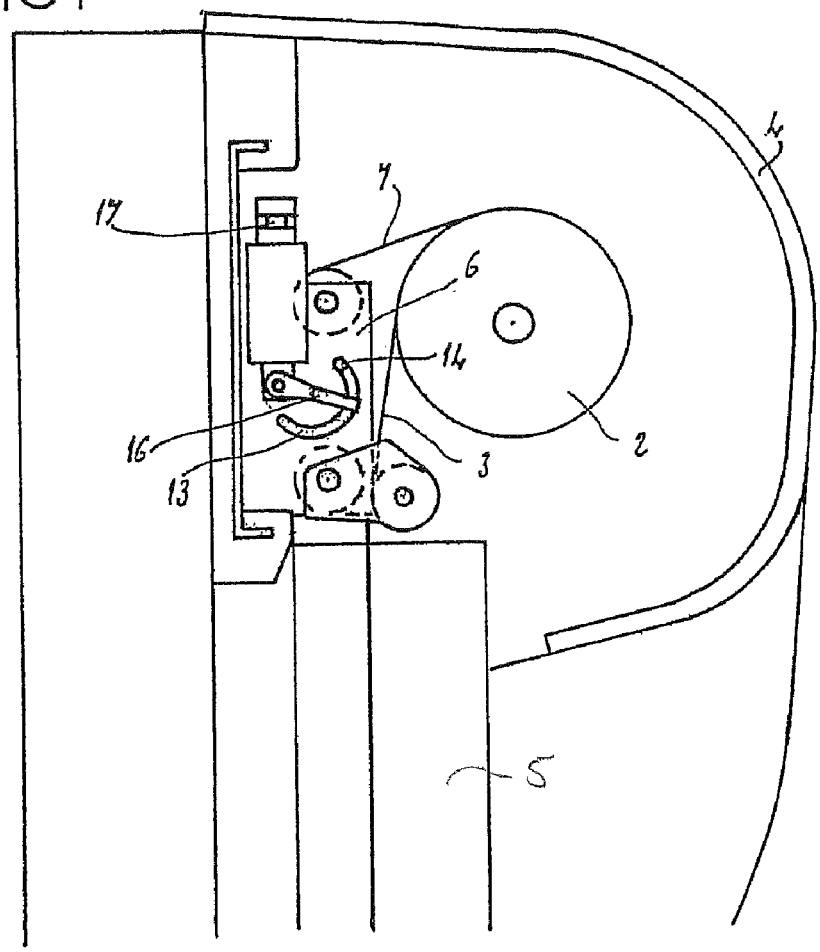
FIG. 1 is a side view of a door level with the upper part.

In the following description, those elements which are common to the different embodiments bear identical reference numerals.

In FIG. 1, a folding door is represented, comprising a winding shaft 2 on which straps 3 and 7 are wound. In the customary manner, this door has a cowling 4 and jambs 5 serving to guide the side edges of the screen.

FIG. 1 represents only the upper part of this door, which door, moreover, has totally traditional characteristics.

As can be seen in FIG. 1, this door is different insofar it is equipped with a tension detector 6 for the strap 7. This tension detector 6 is fitted on the door level with its lintel.

Figure 5:
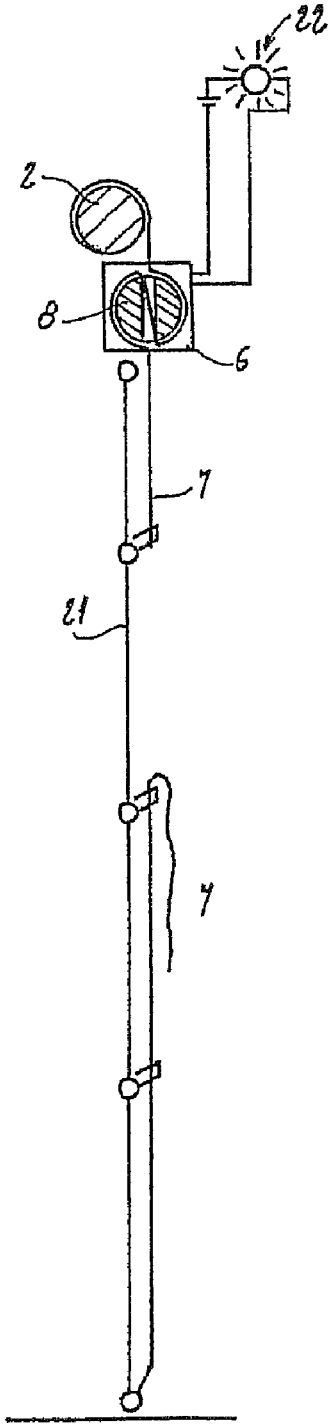
FIG. 5 to 7 illustrate schematically the operation of roll-up or folding doors in normal and abnormal mode.

As can be seen in FIG. 5, the so-called traction strap 7 is fixed, on the one hand, on the winding shaft 2 and, on the other hand, on the screen level with the lower edge 8 of the latter. The traction strap 7 is kept taut by the weight of the screen, which, in numerous cases, incorporates transverse stiffening rods. The strap 3 covers the traction strap 7 and has the task of preventing the fall of the screen in case of breakage or distension of the strap 7.

Figure 2:
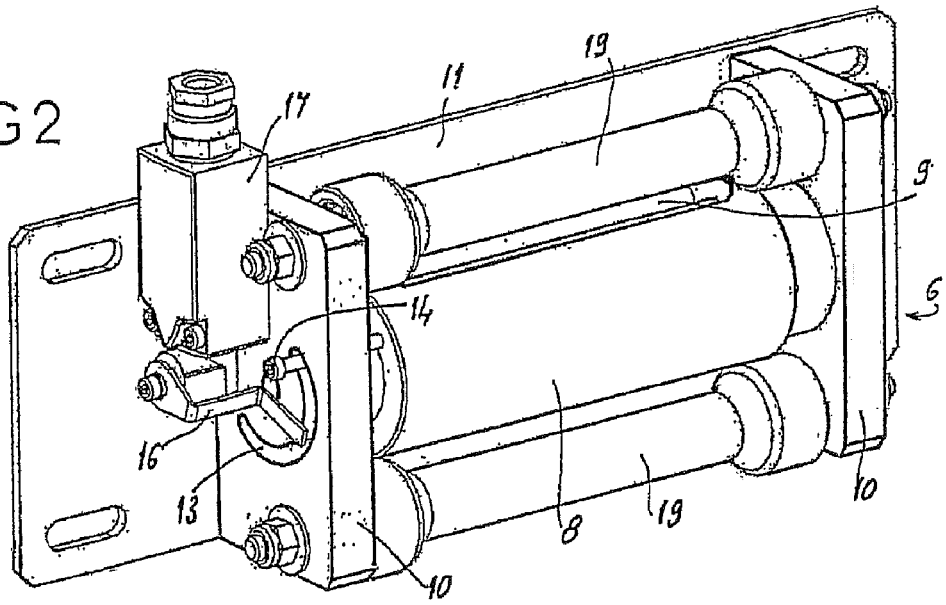
FIG. 2 is a perspective view of a tension detector fitted to this door.

FIG. 2 shows, in greater detail, the tension detector 6 fitted level with the lintel of the door of FIG. 1.

This tension detector 6 has a cylinder 8 in which there is made a diametral slit 9 traversing the cylinder 8. The cylinder 8 is supported by two end plates 10, themselves fixed on a base plate 11.

The cylinder is connected to each of the end plates 10 by a hinged joint, which allows a rotation of the cylinder relative to these latter. A return spring pulls the cylinder 8 into a position in which the slit 9 is orientated in a direction perpendicular to the base plate 11.

It will be noted, moreover, that one of the end plates is provided with a circular-arc-shaped groove 13, in which runs a pin 14 integral with the cylinder 8. This groove 13 extends over an angular sector of the order of 180° and corresponds to the two extreme positions of the cylinder 8.

The end plate 10 supports a pick-up 17, to which is adjoined a finger 16 located on the course of the pin 14.

It will equally be noted that the tension detector 6 is equipped with two cylindrical rollers 19 placed on either side of the cylinder 8. The operation of the tension detector is therefore as follows.

Figure 3:
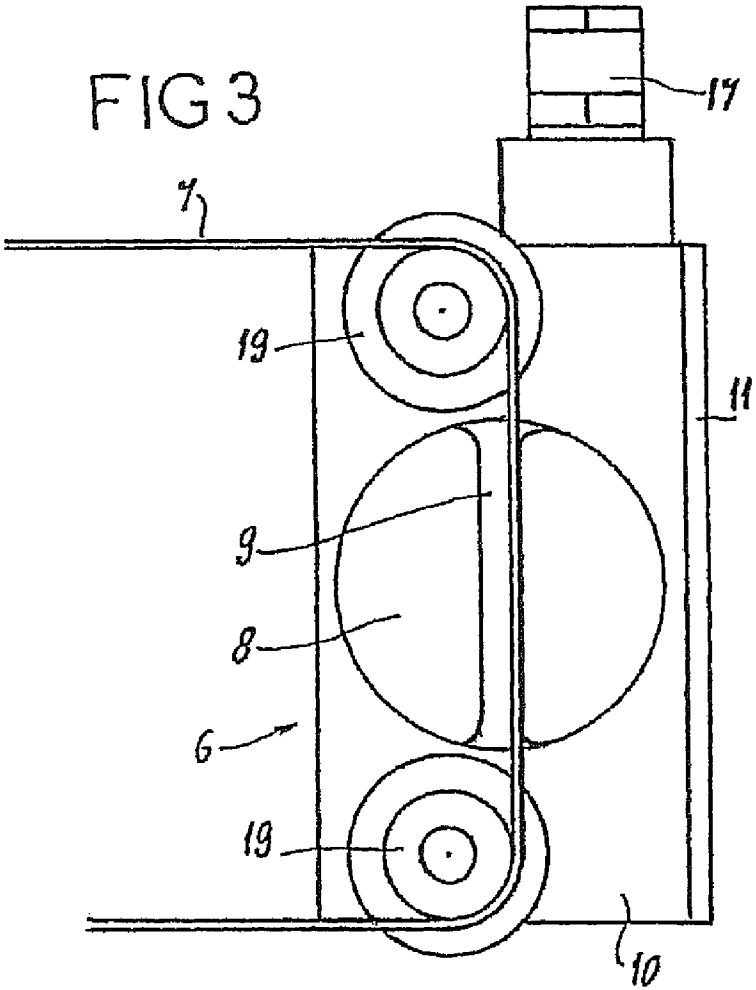
FIG. 3 is a cross-sectional view of this detector in a first position.

As can be seen in FIG. 1, the tension detector 6 is extremely compact. In normal working of the door, the tension detector 6 is in a configuration illustrated by FIG. 3. In this operating mode, the strap 7 ensures an orientation of the slit 9 made in the cylinder such that the slit is substantially parallel to the base plate. This orientation of the cylinder is due exclusively to the action of the strap 7.

In this configuration, the strap 7 slides in the tension detector according to the upward or downward movements of the screen 21.

It will be noted, moreover, that in this configuration the pin 14 is located at the bottom of the course of the circular-arc-shaped groove.

In the case of an abnormal event, for example a breakage of the strap 7 as illustrated in FIG. 5, the strap 7 which is broken is then devoid of tension.

The consequence of this absence of tension in the strap 7 is that the return spring which acts upon the cylinder 8 of the tension detector 6 pivots said cylinder.

Figure 4:
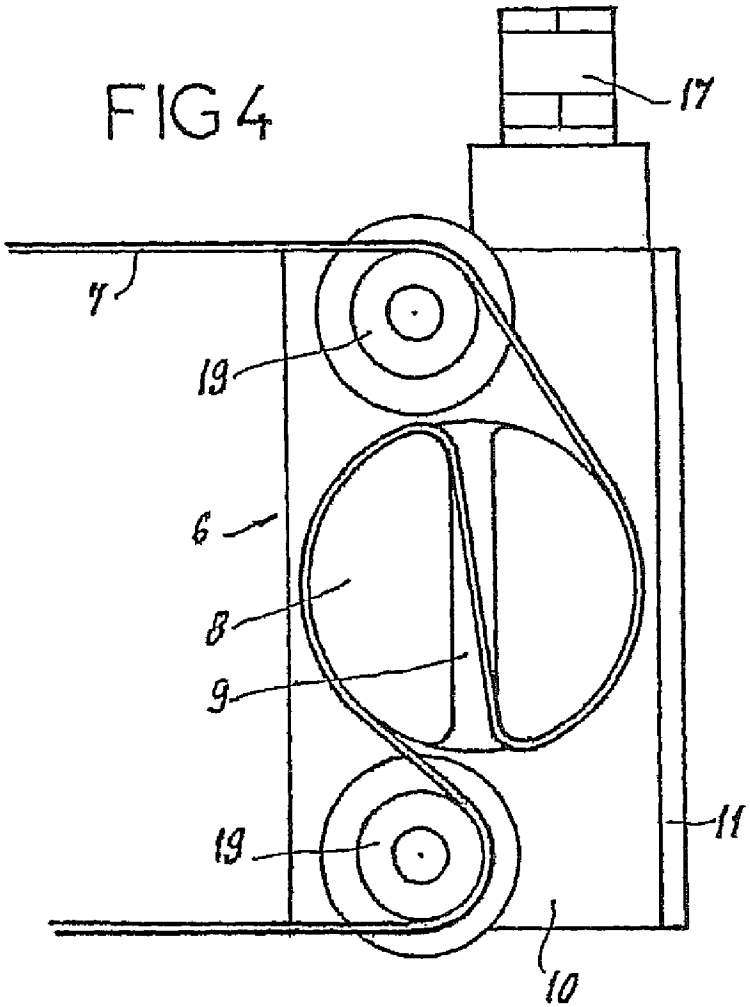
FIG. 4 is a cross-sectional view of this detector in a second position thereof.

FIG. 4 illustrates in this case the configuration of the tension detector 6. In the course of the rotation of the cylinder, the pin 14 makes contact, in the course of its travel in the circular-arc-shaped groove 13, with the finger 16, which acts upon the pick-up 17. The latter orders a warning action, which, in the example represented in FIG. 5, is the lighting of a lamp 22.

Several types of alarms can then be triggered: this may take the form of a sound alarm; equally, the motor driving the rotation of the shaft 2 may be ordered to immediately stop its action or reverse its direction of rotation in order to raise the screen 21 up again using an unbroken traction strap 3.

In another case of abnormal working of the screen, that is to say in case of an intrusion attempt through raising of the lower edge 8 of the screen 21 when the door is in the closed position, the tension detector 6 acts in the same manner. In fact, the raising of the lower edge of the screen 21, to which one end of the strap 7 is fixed, gives rise to a lowering of the tension of said strap. When this tension reduction reaches a certain value, the return spring acts upon the cylinder 8 and tilts the latter toward its position in which it is found illustrated in FIG. 4.

This can equally trigger a visual 22 or sound alarm indicating an anomaly on the door in question.

One advantage which is important to note is that the tension detector 6, as represented, constitutes a compact module that can be fitted to existing doors which are devoid of a security system.

Figure 6:
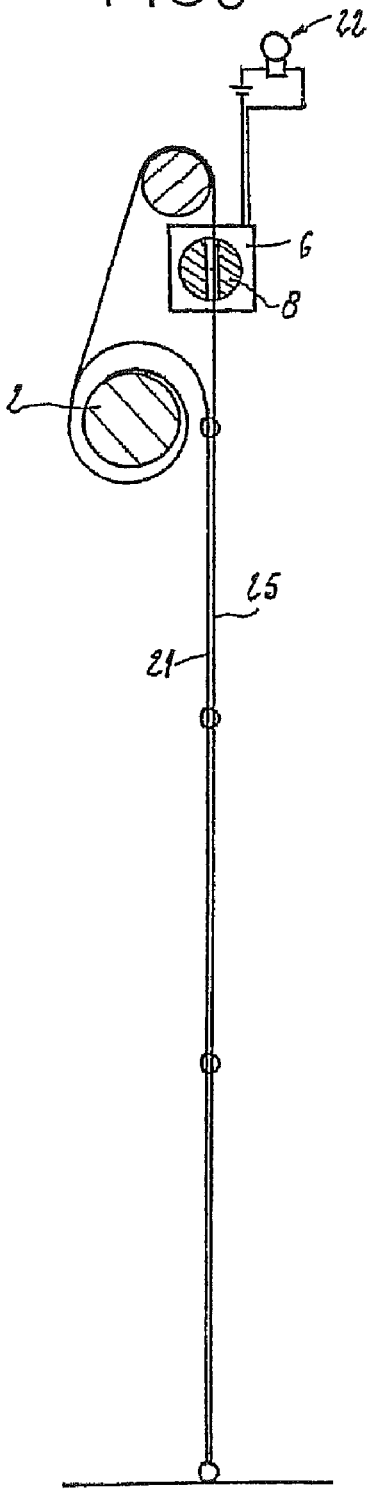
Figure 7:
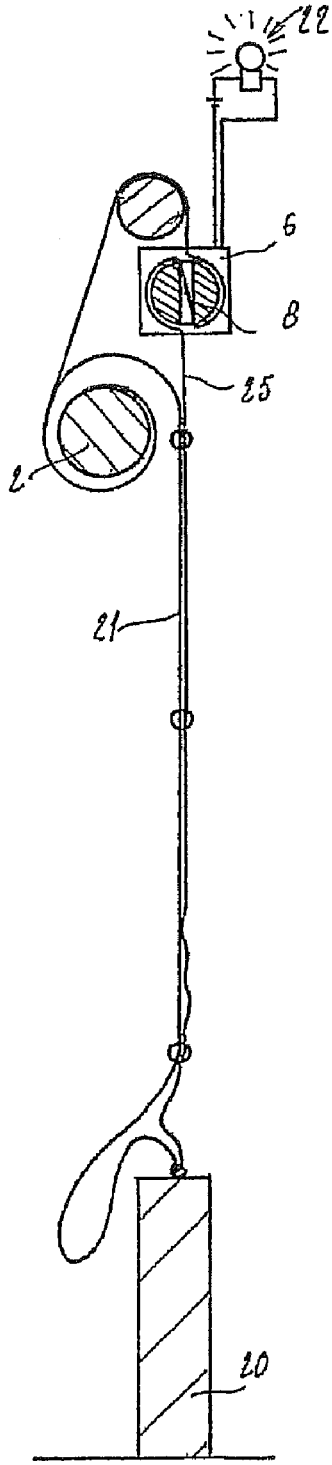

In addition, it should be pointed out that this tension detector can also be fitted to roll-up doors, as is shown by FIGS. 6 and 7, that is to say doors in which the screen 21.

In this case, the door is equipped with an indicator strap 25, which does not participate in the raising of the screen 21, but merely follows the movements of the screen and is thus representative of a normal working of the screen.

When the screen lowers onto an obstacle 20, as is shown by FIG. 7, the rotation of the shaft 2 continues and the strap 25 is no longer tensioned by the weight of the screen 21.

The consequence of this tension reduction is that the return spring which acts upon the cylinder 8 of the tension detector 6 pivots the latter until it is back in the configuration illustrated in FIG. 4.

This can then trigger a sound or visual alarm or trigger an action to re-raise the screen 21.

The described invention has the numerous advantages as previously described. In fact, doors which are thus defined (whether they are of the folding or roll-up type) therefore have a secure operation, insofar as any malfunction is detected with great reliability.

Of course, the invention is not limited to the door previously described by way of non-limiting example, but, on the contrary, embraces all embodiments thereof.

The invention claimed is:

1. A door closing an aperture in a partition, the door comprising:

a flexible screen, a screen raiser, comprising a winding shaft fixed on a lintel of the door, and a strap, whereof one end is fixed on the winding shaft and another end is fixed on the lower edge of the screen, wherein the strap passes through a tension detector comprising a cylinder that is rotatable about an axis, the cylinder having a slit that passes through the axis of the cylinder and in which the strap is engaged, the cylinder being held in a first working position when the strap is under tension, the cylinder rotating into a second working position whenever the strap has a tension less than a predetermined threshold.

2. The door as claimed in claim 1, wherein the displacement of the cylinder from the first working position to the second working position triggers a warning element.

3. The door as claimed in claim 1, wherein the cylinder is supported by two end plates.

4. The door as claimed in claim 3, wherein the cylinder includes a pin traversing a circular-arc-shaped groove defined by one of the end plates, the pin being engageable with a finger connected to a warning element when the cylinder is in the second working position.

5. The door as claimed in claim 4, wherein the tension detector has at least one cylindrical roller, by which the strap can be guided toward the cylinder.

6. The door as claimed in claim 1, wherein the door is a folding door, said strap being configured to tow the screen.

7. The door as claimed in claim 1, wherein the door is a roll-up door, and the strap is an indicator strap configured to signal a tension condition of the screen.

8. The door as claimed in claim 1, wherein said slit is defined by slit walls separated by a width of said slit, and a length of said slit extends from a fist opening of said slit to a second opening of said slit, wherein said length is greater than said width.

* * * * *